US011001969B2

(12) United States Patent
Backfolk et al.

(10) Patent No.: US 11,001,969 B2
(45) Date of Patent: May 11, 2021

(54) PROCESS FOR CREATING A FOAM UTILIZING AN ANTIMICROBIAL STARCH WITHIN A PROCESS FOR MANUFACTURING A PAPER OR BOARD PRODUCT

(71) Applicant: Stora Enso OYJ, Helsinki (FI)

(72) Inventors: Kaj Backfolk, Villmanstrand (FI); Isto Heiskanen, Imatra (FI); Esa Saukkonen, Lappeenranta (FI); Kirsi Partti-Pellinen, Imatra (FI); Simo Siitonen, Rautjärvi (FI)

(73) Assignee: Stora Enso OYJ, Helsinki (FI)

( * ) Notice: Subject to any disclaimer, the term of this patent is extended or adjusted under 35 U.S.C. 154(b) by 0 days.

(21) Appl. No.: 16/316,790

(22) PCT Filed: Jul. 3, 2017

(86) PCT No.: PCT/IB2017/054005

§ 371 (c)(1),
(2) Date: Jan. 10, 2019

(87) PCT Pub. No.: WO2018/011667

PCT Pub. Date: Jan. 18, 2018

(65) Prior Publication Data

US 2019/0226144 A1 Jul. 25, 2019

(30) Foreign Application Priority Data

Jul. 11, 2016 (SE) ..... 1651026-5

(51) Int. Cl.

| | |
|---|---|
| ***D21F 11/00*** | (2006.01) |
| ***D21H 17/28*** | (2006.01) |
| ***D21H 21/36*** | (2006.01) |
| ***D21H 21/56*** | (2006.01) |
| *D21H 19/22* | (2006.01) |

(52) U.S. Cl.
CPC ..... *D21F 11/002* (2013.01); *D21H 17/28* (2013.01); *D21H 21/36* (2013.01); *D21H 21/56* (2013.01); *D21H 19/22* (2013.01)

(58) Field of Classification Search
None
See application file for complete search history.

(56) References Cited

U.S. PATENT DOCUMENTS

| | | | | |
|---|---|---|---|---|
| 3,210,240 | A | 10/1965 | Read et al. | |
| 4,184,914 | A | 1/1980 | Jenkins | |
| 4,597,831 | A | 7/1986 | Anderson | |
| 6,103,060 | A | 8/2000 | Munerelle et al. | |
| 2002/0182381 | A1 | 12/2002 | Kukarni et al. | |
| 2006/0008513 | A1* | 1/2006 | Holbert | A01N 25/34 424/443 |
| 2008/0139441 | A1* | 6/2008 | Xiao | A01N 47/44 510/319 |
| 2014/0303322 | A1 | 10/2014 | Xiao et al. | |
| 2015/0096700 | A1 | 4/2015 | Heiskanen et al. | |

FOREIGN PATENT DOCUMENTS

| | | |
|---|---|---|
| CN | 1083773 A | 3/1994 |
| CN | 1860160 A | 11/2006 |
| CN | 101245572 A | 8/2008 |
| CN | 103012606 | 4/2013 |
| CN | 103724441 | 4/2014 |
| EP | 2843130 | 3/2015 |
| WO | 8403112 | 8/1984 |
| WO | 2013160564 | 10/2013 |
| WO | 2015036659 | 3/2015 |

OTHER PUBLICATIONS

International Searching Authority, Written Opinion of the International Searching Authority, PCT/IB2017/054005, dated Jan. 18, 2018.

International Searching Authority, International Search Report, PCT/IB2017/054005, dated Jan. 18, 2018.

Chinga-Carrasco, G., "Cellulose fibres, nanofibrils and microfibrils,: The morphological sequence of MFC components from a plant physiology and fibre technology point of view," Nanoscale research letters 2011, 6:417.

Fengel, D., "Ultrastructural behavior of cell wall polysaccharides," Tappi J., Mar. 1970, vol. 53, No. 3.

Ziaee, Z. et al., "Antimicrobial/antimold polymer-grafted starches for recycled cellulose fibers," Journal of Biomaterials Science, Polymer Edition, 2010, vol. 21, No. 10, pp. 1359-1370, ISSN 0920-5063.

Zainab Ziaee , Liying Qian , Yong Guan , Pedram Fatehi & Huining Xiao (2010) Antimicrobial/Antimold Polymer-Grafted Starches for Recycled Cellulose Fibers, Journal of Biomaterials Science, Polymer Edition, 21:10, 1359-1370, DOI: 10 .1163/092050609X 12517190417795.

English translation of Chinese Office Action issued for corresponding Chinese patent application No. 201780041717.2 dated Nov. 6, 2020.

* cited by examiner

*Primary Examiner* — Dennis R Cordray
(74) *Attorney, Agent, or Firm* — Greer, Burns & Crain, Ltd.

(57) ABSTRACT

The present invention relates to a new process for creating foam in a process for manufacturing a paper or board product. According to the present invention, certain types of antimicrobial starch is used in the creation of the foam.

8 Claims, No Drawings

PROCESS FOR CREATING A FOAM UTILIZING AN ANTIMICROBIAL STARCH WITHIN A PROCESS FOR MANUFACTURING A PAPER OR BOARD PRODUCT

This application is a U.S. National Phase under 35 U.S.C. § 371 of International Application No. PCT/IB2017/054005, filed Jul. 3, 2017, which claims priority under 35 U.S.C. §§ 119 and 365 to Swedish Application No. 1651026-5, filed Jul. 11, 2016.

TECHNICAL FIELD

The present invention relates to a new process for creating foam in a process for manufacturing a paper or board product. According to the present invention, certain types of antimicrobial starch is used in the creation of the foam.

BACKGROUND

Food and food products, including packaged foods and food products, are generally subject to two main problems: microbial contamination and quality deterioration. The primary problem regarding food spoilage in public health is microbial growth. If pathogenic microorganisms are present, then growth of such microorganisms can potentially lead to food-borne outbreaks and significant economic losses. Food-borne diseases cause illness, hospitalizations and deaths. There is thus clearly a need for effective means for preserving food and food products in order to ensure food safety.

Currently, food manufacturers use different technologies, such as heating, to eliminate, retard, or prevent microbial growth. However, effective sanitation depends on the product/process type, and not all currently available technology can deliver an effective reduction of microorganisms. Instead, another level of health problems may be created, or the quality of the treated food may deteriorate. For example, chlorine is and has been widely used as a sanitizer. However, concerns regarding the safety of carcinogenic and toxic byproducts of chlorine, such as chloramines and trihalomethanes, have been raised in recent years. Another example is heat treatment. Even though heat is very efficient in killing bacteria, it also destroys some nutrients, flavors, or textural attributes of food and food products.

Ozone has also been utilized as a means of reducing spoilage microorganisms in food and food products. Its effectiveness is generally compromised, however, by high reactivity and relatively short half-life in air. Ozone decomposition is also accelerated by water, certain organic and inorganic chemicals, the use of higher temperatures and pressures, contact with surfaces, particularly organic surfaces, and by turbulence, ultrasound and UV light. As a consequence, unlike other gases, ozone is not generally suitable for storage for other than short periods of time. The use of gaseous ozone for the treatment of foods also presents certain additional problems, including non-uniform distribution of ozone in certain foods or under certain storage conditions. As a result, the potential exists for overdosing in areas close to an ozone entry location, while those areas remote from the entry location may have limited exposure to an ozone containing gas. A further important consideration in the use of ozone is the generally relatively high cost associated with ozone generation on a commercial scale, including the costs associated with energy and the destruction of off-gas ozone.

To avoid the issues related to microbial contamination and quality deterioration of packaged food, the packaging material and packages used can also play an important role.

A process-related problem is that starch is generally prone to microbial degradation and thereby higher microbial activity in the process water. In particular, during standstill of machinery used in the manufacture of a paper or board product, high microbial growth is common which may lead to reduced strength properties when the broke is re-used in the process.

Foam forming and foam coating are technologies which are increasingly used in the manufacture or surface treatment of paper, paper products and board. By using a foam forming in the wet end of a paper machine and/or foam coating or foam dosing in a size press or coating unit, the amount of solids can be increased and, when used in the wet end of a paper machine, flocculation can be avoided. The benefit of using foam coating or surface sizing with foam is that relatively small amounts can be applied to the surface of the substrate.

One particular issue when using foaming is that surface active chemicals, such as surfactants or tensides, are often required. Typical amounts of sodium dodecyl sulfate (SDS) required to create a foam is from 0.05 to 0.6 g/l in the furnish in a process for manufacturing paper or board. Although beneficial in creating a foam, chemicals such as tensides may also be detrimental in the manufacture of a paper, paperboard, coating or a film. Surfactants typically have negative effects on strength properties since they interfere with the fiber-fiber bonding. Surfactants also negatively influence hydrophobicity. Thus, the presence of surfactants causes problems when producing paper/board grades which need high strength and hydrophobicity, such as liquid packaging boards, food service boards, liner board etc.

In foam forming technique aiming at increasing the bulk of a fibrous sheet, the pulp or furnish is turned into a foamed suspension as it is fed from a headbox to a forming fabric of a paper or board machine. Characteristic for foam forming is that the bulk is typically higher but the tensile index is lower as compared to normal papermaking process. A bulkier structure is more porous, which brings about the lower tensile index. Foam forming requires use of a surfactant, which affects both the dry and the wet tensile strength of the sheet negatively. Such tensile strength loss is believed to be due to the surfactants adsorbing to the fibres and thus hindering hydrogen bonding between the fibres.

The foam forming technique has found use particularly in the making of tissue paper. Otherwise the inferior strength properties as compared to standard wet forming, as well as inferior Scott bond and elastic modulus have deterred use of foam forming for other kinds of papermaking. However, WO2013160553 teaches manufacture of paper or board, in which microfibrillated cellulose (MFC) is blended with pulp of a higher fibre length and turned to a fibrous web by use of foam forming. Especially a middle layer with an increased bulk is thereby produced for a multilayer board. MFC is purposed to build bridges between longer fibres and thereby lend the resulting paper or board an increased strength. The technique is said to be applicable for folding boxboard and several other paper and board products.

U.S. Pat. No. 4,184,914 is directed to the use of a hydrolyzed proteinaceous foam in paper manufacture. The hydrolyzed proteinaceous foam is said to not appreciably affect the degree of sizing of the finished paper sheet.

WO2013160564 A1 is directed to the preparation of a web layer through the steps of i) bringing water, microfibrillated cellulose, hydrophobic size and a heat-sensitive surfactant into a foam, ii) supplying the foam onto a forming fabric, iii) dewatering the foam on the forming fabric by suction to form a web, iv) subjecting the web to drying and v) heating the web to suppress the hydrophilic functionality of the surfactant.

Another approach for utilizing foam in the manufacture of shaped products is described in WO2015036659 A1. According to this reference natural and synthetic fibres are turned to an aqueous foamed suspension, which is fed into a mould and dried to a fibrous product such as a three-dimensional package, with a corresponding shape. By feeding different foamed suspensions at multiple steps the mould can be used to make products having a multilayer wall structure.

There is thus a need for improved products for packaging, particularly products that can help address the issues related to microbial contamination and quality deterioration of packaged food. There is also a need for improved process for the manufacture of such products.

SUMMARY

It has surprisingly been found that certain types of modified starch have particularly advantageous properties when used to create foam in a process for manufacturing a paper or board product.

Surprisingly, foam created in the presence of the modified starch in accordance with the present invention has unexpectedly even bubble size and is sufficiently stable. By using the modified starch, it is possible to create a controllable foam with even bubble size in the absence of tensides or using a reduced amount of tensides. According to the present invention, very good retention is achieved. Problems in the waste water plant as well as foaming in chests is also avoided, thereby facilitating the production process. In addition, the antimicrobial properties of the modified starch are beneficial to reduce the risk of microbial contamination and quality deterioration of food packaged using products according to the present invention.

The present invention is thus directed to a process for creating a foam in a process for manufacturing a paper or board product, comprising the steps of a) providing antimicrobial starch, wherein said starch has at least 1% by weight of grafted polymer, said grafted polymer being an amino-containing polymer which has antimicrobial activity against *E. coli* and *S. aureus* of a minimum inhibitory concentration of 50 ppm or less; and b) mixing the antimicrobial starch with water in the presence of air in an aqueous phase to obtain a foamed suspension.

The term antimicrobial starch as used herein is defined as the modified starch described in US2014/0303322. The antimicrobial starch used in accordance with the present invention can be prepared as described in US2014/0303322 A1.

The present invention is also directed to a paper or board product manufactured using foam created in accordance with the present process. Examples of such paper or board products includes tissues (such as wet tissues), wall paper, insulation material, moldable products, egg cartons, agricultural films such as mulch, transparent or translucent films, nonwoven products, threads, ropes, bio-textiles, textiles and other paper or board products in which antimicrobial effects are advantageous. In one embodiment of the present invention, the paper or board product manufactured according to the present invention is or contains a film comprising microfibrillated cellulose (MFC). In one embodiment, the MFC film is manufactured using foam forming according to the present invention. In one embodiment, the MFC film is foam coated according to the present invention.

DETAILED DESCRIPTION

In one embodiment of the present invention, the process is carried out in a paper or board machine or in equipment arranged near or connected to a paper machine. The process can also be a wet laid technique or modified method thereof. The generated foam could also be deposited with a surface treatment unit or impregnation unit such as film press, size press, blade coating, curtain coating, spray, or a foam coating applicator/coater.

In one embodiment of the present invention, the process is carried out in the wet end of a process for manufacturing a paper or board product.

In one embodiment of the present invention, in foam coating, the amount of antimicrobial starch used is at least 0.25 g/m$^2$.

In one embodiment of the present invention, in foam forming, the amount of antimicrobial starch used is at least 0.05 kg/ton paper or board product, such as 0.05 to 500 kg/ton or 1 to 50 kg/ton or 1 to 25 kg/ton or 5 to 15 kg/ton paper or board product.

The air content in step b) is typically in the range of from 30% to 70% by volume, such as in the range of from 35% to 65% by volume.

The foam created in accordance with the present invention prevents fiber flocculation, thus giving improved formation. The foam generally disappears in/on the wire section as the solids increase and water is sucked from the web with vacuum or pressure or centrifugal forces. The foam helps create higher solids content from the wire section as well as increased bulk of the end product. The foam is also beneficial to enhance the mixing of long fibers.

The foam obtained according to the present invention has a sufficiently even bubble size, i.e. the size distribution of the bubbles is narrow. The foam obtained according to the present invention is also controllable, i.e. when the amount of air is increased or decreased the bubbles remain of an even size, i.e. a narrow bubble size distribution is maintained. The foam obtained according to the present invention is also sufficiently stable, i.e. the foam is maintained for a sufficient period of time. These parameters, i.e. bubble size and foam stability, can be determined using methods known in the art.

Sodium dodecyl sulphate (SDS) is typically required as a foaming aid. However, it generally causes problems when used in a paper or board machine. It typically prevents fiber-fiber bondings, thus causing weaker strength properties of the material produced. In addition, from a process efficiency point of view, the SDS ends up in the water and causes problems i.e. in the waste water treatment plant. However, by the use of certain types of modified starch as defined above in step a), the use of SDS can be avoided or significantly reduced. When antimicrobial starch is used in accordance with the present invention, a synergistic effect of the addition of tenside or surface active polymer can be observed on the strength and evenness of the foam. In one embodiment, the amount of tenside used is less than 0.2 g/l in the furnish, preferably less than 0.1 g/l or less than 0.05 g/l or less than 0.02 g/l. In one embodiment of the present invention, no tenside is used.

In one embodiment of the present invention, the antimicrobial starch can be used in combination with other agents useful to create and/or stabilize foam, such as PVA, proteins (such as casein) and/or hydrophobic sizes. The foam may also contain other components such as natural fibers, such as cellulose fibers or microfibrillated cellulose (MFC).

In one embodiment of the present invention, the foam is used in a foam coating process.

In a foam coating process, the created foam prevents coating color or surface size starch penetration into the structure of the paper or board being manufactured. More specifically, air bubbles in the foam prevent penetration of the coating color or surface sizing starch into the structure of the paper or board being produced. By use of the foam, the surface produced becomes less porous, thereby having improved optical properties or improved physical properties for printing. The foam also makes it possible to increase the solid content. In addition to improve the optical or physical performance of the coated substrate, the said foam coating can be used to make dispersion coating in order to provide barrier properties, such as in the manufacture of grease resistance paper which may optionally contain MFC.

In one embodiment of the present invention, a foam generator is used to create the foam. In one embodiment of the present invention, the created foam is dosed to a size press. The foam coating may be carried out in the wet end of a papermachine, as a curtain coating of the wet-web. One benefit of using foam coating is this context is that with the use of foam, the solids have an improved tendency to stay on the surface of the base web.

The foam obtained according to the present invention can also be used in cast coating or blade coating.

In one embodiment of the present invention, high-pressure air is used when creating the foam.

The antimicrobial starch used in accordance with the present invention can be prepared as described in US2014/0303322 A1. The minimum inhibitory concentration can be determined using methods known in the art.

The antimicrobial starch is prepared by grafting a reactive amino-containing polymer (ACP) onto starch using ceric ammonium nitrate $[Ce(NH_4)_2(NO_3)_6]$ as an initiator in the graft copolymerization. A person of ordinary skill in the art would understand that other initiators could be used, such as potassium persulfate or ammonium persulfate. In one embodiment, the amino-containing polymer is a guanidine-based polymer. In one embodiment, the amino-containing polymer is polyhexamethylene guanidine hydrochloride. In one embodiment, a coupling agent is added when preparing the antimicrobial starch. In one embodiment, the coupling agent is selected from the group consisting of glycerol diglycidyl ether and epichlorohydrin.

The foam may also contain pulp prepared using methods known in the art. Examples of such pulp include Kraft pulp, mechanical, chemical and/or thermomechanical pulps, dissolving pulp, TMP or CTMP, PGW etc. In one embodiment of the present invention, microfibrillated cellulose is used for stabilization of the foam created in accordance with the present invention.

The foam according to the present invention may also contain microcrystalline cellulose and/or nanocrystalline cellulose.

The foam and and/or the paper or board product manufactured may also comprise other bioactive agents, such as other antimicrobial agents or chemicals, such as antimicrobial agents that are approved for direct or indirect contact with food.

Microfibrillated cellulose (MFC) shall in the context of the patent application mean a nano scale cellulose particle fiber or fibril with at least one dimension less than 100 nm. MFC comprises partly or totally fibrillated cellulose or lignocellulose fibers. The liberated fibrils have a diameter less than 100 nm, whereas the actual fibril diameter or particle size distribution and/or aspect ratio (length/width) depends on the source and the manufacturing methods.

The smallest fibril is called elementary fibril and has a diameter of approximately 2-4 nm (see e.g. Chinga-Carrasco, G., *Cellulose fibres, nanofibrils and microfibrils,: The morphological sequence of MFC components from a plant physiology and fibre technology point of view, Nanoscale research letters* 2011, 6:417), while it is common that the aggregated form of the elementary fibrils, also defined as microfibril (Fengel, D., *Ultrastructural behavior of cell wall polysaccharides, Tappi J.,* March 1970, Vol 53, No. 3.), is the main product that is obtained when making MFC e.g. by using an extended refining process or pressure-drop disintegration process. Depending on the source and the manufacturing process, the length of the fibrils can vary from around 1 to more than 10 micrometers. A coarse MFC grade might contain a substantial fraction of fibrillated fibers, i.e. protruding fibrils from the tracheid (cellulose fiber), and with a certain amount of fibrils liberated from the tracheid (cellulose fiber).

There are different acronyms for MFC such as cellulose microfibrils, fibrillated cellulose, nanofibrillated cellulose, fibril aggregates, nanoscale cellulose fibrils, cellulose nanofibers, cellulose nanofibrils, cellulose microfibers, cellulose fibrils, microfibrillar cellulose, microfibril aggregrates and cellulose microfibril aggregates. MFC can also be characterized by various physical or physical-chemical properties such as large surface area or its ability to form a gel-like material at low solids (1-5 wt %) when dispersed in water. The cellulose fiber is preferably fibrillated to such an extent that the final specific surface area of the formed MFC is from about 1 to about 300 $m^2/g$, such as from 1 to 200 $m^2/g$ or more preferably 50-200 $m^2/g$ when determined for a freeze-dried material with the BET method.

Various methods exist to make MFC, such as single or multiple pass refining, pre-hydrolysis followed by refining or high shear disintegration or liberation of fibrils. One or several pre-treatment step is usually required in order to make MFC manufacturing both energy efficient and sustainable. The cellulose fibers of the pulp to be supplied may thus be pre-treated enzymatically or chemically, for example to reduce the quantity of hemicellulose or lignin. The cellulose fibers may be chemically modified before fibrillation, wherein the cellulose molecules contain functional groups other (or more) than found in the original cellulose. Such groups include, among others, carboxymethyl (CM), aldehyde and/or carboxyl groups (cellulose obtained by N-oxyl mediated oxydation, for example "TEMPO"), or quaternary ammonium (cationic cellulose). After being modified or oxidized in one of the above-described methods, it is easier to disintegrate the fibers into MFC or nanofibrillar size fibrils.

The nanofibrillar cellulose may contain some hemicelluloses; the amount is dependent on the plant source. Mechanical disintegration of the pre-treated fibers, e.g. hydrolysed, pre-swelled, or oxidized cellulose raw material is carried out with suitable equipment such as a refiner, grinder, homogenizer, colloider, friction grinder, ultrasound sonicator, fluidizer such as microfluidizer, macrofluidizer or fluidizer-type homogenizer. Depending on the MFC manufacturing method, the product might also contain fines, or nanocrystalline cellulose or e.g. other chemicals present in wood fibers or in papermaking process. The product might also contain various amounts of micron size fiber particles that have not been efficiently fibrillated. MFC is produced from wood cellulose fibers, both from hardwood or softwood fibers. It can also be made from microbial sources, agricultural fibers such as wheat straw pulp, bamboo, bagasse, or other non-wood fiber sources. It is preferably made from pulp including pulp from virgin fiber, e.g. mechanical, chemical and/or thermomechanical pulps. It can also be made from broke or recycled paper.

The above described definition of MFC includes, but is not limited to, the new proposed TAPPI standard W13021 on cellulose nanofibril (CMF) defining a cellulose nanofiber material containing multiple elementary fibrils with both crystalline and amorphous regions.

EXAMPLES

Example 1. Foam Coating in Size Press

Trials were conducted on a pilot paper machine. The production rate on pilot paper machine was 45 m/min and grammage of the base board 130 g/m$^2$. In addition to CTMP pulp, cationic starch (6.0 kg/tn), alkyl succinic anhydride, ASA, (700 g/tn), alum (600 g/t), and two component retention system (100 g/tn cationic polyacryl amide, and 300 g/tn silica) were used in the furnish. The paper web was on-line surface sized with starch (Raisamyl 21221) or antimicrobial starch on a size press unit. The surface size uptake was 0.64 g/m$^2$ and 0.95 g/m$^2$ for the Raisamyl 21221 and antimicrobial starch, respectively. The paper was dried to 8% end moisture content, reeled and cut into sheets.

As a reference sample, size press starch Raisamyl 21221, in solids 5% was used. In the reference sample, no foamed starch and no tensides were used. The surface energy (2 liquid method) top side was determined and was found to be 24.4 mJ/m$^2$. When PE coated, it was found that the PE adhesion was very good, the plastic was totally bound and the fibers were splitting when PE was torn away.

As a test sample, size press antimicrobial starch, solids 5% was used. The antimicrobial starch was foamed in the absence of tensides. The surface energy (2 liquid method) top side was determined and was found to be 24.3 mJ/m$^2$. When PE coated, it was found that the PE adhesion was very good, the plastic was totally bound and the fibers were splitting when PE was torn away.

Example 2. Foaming

The foaming tendency of antimicrobial starch was compared to traditional cationic wet-end starch (Raisamyl 50021). Both starches were cooked and diluted to 1% consistency, then mixed with a mixer with 6000 rpm propeller speed for 15 minutes. Amount of sample in the mixing was 300 ml.

For antimicrobial starch the stability of the foam phase was studied as the content of foam turned into water as a function time. For this measurement 100 ml of foam was taken to a beaker and the content of the water phase was measured after several time intervals. Results for 3 parallel mixing batches of antimicrobial starch (ANTIMIC) and 1 mixing batch of traditional cationic wet-end starch (REF) are presented in Table 1.

TABLE 1

CONTENT (ML) OF FOAM TURNED INTO WATER AS A FUNCTION TIME.

| | Foam | Content of foam turned into water, ml from 100 ml | | | | | | |
|---|---|---|---|---|---|---|---|---|
| | density kg/m3 | 5 min | 10 min | 20 min | 30 min | 40 min | 50 min | 60 min |
| ANTIMIC 1 | 202 | 11 | 16 | 18 | 20 | 20 | 20 | 20 |
| ANTIMIC 2 | 285 | 25 | 27 | 28 | 28 | 28 | 29 | 29 |
| ANTIMIC 3 | 240 | 18 | 21 | 22 | 23 | 23 | 23 | 23 |
| REF | | No foam | | | | | | |

Furthermore, the antimicrobial starch and traditional cationic wet-end starch were compared as a foaming agent of chemi-thermomechanical pulp (CTMP). Consistency of CTMP slurry was 1.0%. Slurry was mixed with a mixer with 6000 rpm propeller speed for 15 minutes. Amount of sample in the mixing was 300 ml.

For antimicrobial starch+CTMP the stability of the foam phase was studied as the content of foam turned into water as a function time. For this measurement 100 ml of foam was taken to a beaker and the content of the water phase was measured. Results for antimicrobial starch (ANTIMIC) and traditional cationic wet-end starch (REF) are presented in Table 2.

TABLE 2

CONTENT (ML) OF FOAM TURNED INTO WATER AS A FUNCTION TIME.

| | | Content of foam turned into water, ml from 100 ml | | | | | | |
|---|---|---|---|---|---|---|---|---|
| | Density, kg/m3 | 5 min | 10 min | 20 min | 30 min | 40 min | 50 min | 60 min |
| ANTIMIC | 337 | 11 | 16 | 18 | 20 | 20 | 20 | 20 |
| REF | | No foam | | | | | | |

In view of the above detailed description of the present invention, other modifications and variations will become apparent to those skilled in the art. However, it should be apparent that such other modifications and variations may be effected without departing from the spirit and scope of the invention.

The invention claimed is:

1. A process for manufacturing a paper or board product, comprising the steps of a) providing an antimicrobial starch as a foam forming aid, wherein said starch has at least 1% by weight of a grafted polymer, said grafted polymer being an amino-containing polymer which has antimicrobial activity against *E. coli* and *S. aureus* of a minimum inhibitory concentration of 50 ppm or less;

b) mixing the antimicrobial starch with water in the presence of air in an aqueous phase to obtain a foamed suspension; and, c) manufacturing a paper or board product with the foamed suspension obtained in step b)

wherein an amount of antimicrobial starch in the foamed suspension is between 0.05 and 500 kg/ton of the paper or board product, and, wherein an amount of any additional foaming aid in the foamed suspension is less than 0.02 g/L.

2. The process according to claim 1, wherein the amino-containing polymer of the antimicrobial starch is a guanidine-based polymer.

3. The process according to claim 2, wherein the guanidine-based polymer is polyhexamethylene guanidine hydrochloride.

4. The process according to claim 1, wherein the foam is created in the absence of any additional foaming aid.

5. The process according to claim 1, wherein the foam is created in the presence of a foam stabilizer.

6. The process according to claim 1, comprising the addition of microfibrillated cellulose in the creation of the foam.

7. The process according to claim 1, wherein at least step b) is carried out in a wet end of a process for manufacturing a paper or board product.

8. The process according to claim 1, wherein the amount of antimicrobial starch in the foamed suspension is between 1 and 25 kg/ton of the paper or board product.

* * * * *